United States Patent [19]

Ito et al.

[11] Patent Number: 4,517,949

[45] Date of Patent: May 21, 1985

[54] AIR FUEL RATIO CONTROL METHOD

[75] Inventors: Toshimitsu Ito; Toshiaki Isobe, both of Aichi, Japan

[73] Assignee: Toyota Jidosha Kabushiki Kaisha, Toyota, Japan

[21] Appl. No.: 592,005

[22] Filed: Mar. 21, 1984

Related U.S. Application Data

[63] Continuation-in-part of Ser. No. 316,038, Oct. 28, 1981, abandoned.

[30] Foreign Application Priority Data

Jan. 22, 1981 [JP] Japan ..... 56-8202

[51] Int. Cl.[3] ..... F02M 51/00

[52] U.S. Cl. ..... 123/489

[58] Field of Search ..... 123/440, 489

[56] References Cited

U.S. PATENT DOCUMENTS

| | | | |
|---|---|---|---|
| 3,895,611 | 7/1975 | Endo et al. | 123/489 X |
| 4,235,204 | 11/1980 | Rice | 123/489 X |
| 4,321,903 | 3/1982 | Kondo et al. | 123/489 X |
| 4,357,828 | 11/1982 | Nakano | 123/440 X |
| 4,467,770 | 8/1984 | Arimura et al. | 123/489 |

*Primary Examiner*—Parshotam S. Lall
*Assistant Examiner*—W. R. Wolfe
*Attorney, Agent, or Firm*—Cushman, Darby & Cushman

[57] ABSTRACT

A fuel injection quantity is varied by correcting a correction value so that a mean value of a factor of air-fuel ratio feedback correction obtained from the output of an $O_2$ sensor takes a value within a predetermined range centered at a value corresponding to a stoichiometric air-fuel ratio, and a fuel injection quantity is calculated based on a basic fuel injection quantity, the factor of air-fuel ratio feedback correction and the correction value, thereby to effect control so that the air-fuel ratio converges in proximity of the stoichiometric air-fuel ratio.

9 Claims, 8 Drawing Figures

| FIG. 6A | FIG. 6B |
|---|---|

AIR FUEL RATIO CONTROL METHOD

This is a continuation-in-part of the application Ser. No. 316,038 filed Oct. 28, 1981, now abandoned.

BACKGROUND OF THE INVENTION

This invention relates to an air-fuel ratio control method wherein a basic injection duration of a fuel injection valve is calculated in accordance with the operating conditions of an internal combustion engine and an operating duration of the fuel injection valve is controlled based on the basic injection duration, correction values controlled by learning, a non-effective injection duration of the fuel injection valve and a factor of air-fuel ratio feedback correction, so that the air-fuel ratio can be controlled.

DESCRIPTION OF THE PRIOR ART

To meet the demand for better emission control and improved fuel consumption rate, there have been adopted electronic fuel injection systems (hereinafter referred to as "EFI"), so that the air-fuel ratio is controlled to the optimum. The abovementioned EFI may be broadly classified into two types including: a speed density system in which a fuel injection quantity q is calculated through a formula $q \propto f(P_s) \cdot f(N_e)$ (wherein $P_s$ represents pressure in an intake pipe and $N_e$ a rotational speed of the engine), whereby an injection quantity from an injector is controlled; and a mass flow system in which a fuel injection quantity q is calculated through a formula $q \propto Q_a/N_e$ (wherein $Q_a$ represents a quantity of air directly detected by use of an air flow meter and the rotational speed of the engine), whereby an injection quantity from an injector is controlled.

FIG. 1 shows the details of conventional calculation methods in the abovedescribed systems. In each of the abovedescribed methods, a basic injection duration of the fuel injection valve is calculated from each of the detected results, a feedback correction commensurate to a concentration of a specified content in an exhaust gas, a correction of an error due to water temperature and the like are applied to the basic injection duration thus calculated to calculate an effective injection duration $\tau_e$, and a non-effective injection duration $\tau_v$ is added to this effective injection duration $\tau_e$ to obtain an injection duration $\tau_t$, whereby the injection valve is operated for the injection duration $\tau_t$.

However, in an engine in which the fuel injection is controlled according to the abovedescribed speed density system (hereinafter referred to as "D-J system"), such disadvantages are presented that a required fuel injection flow rate of the engine is fluctuated to a considerable extent due to (1) a dispersion in output signals from an intake pressure sensor, (2) the flow rate characteristics of the injector, (3) a tappet clearance, (4) a fluctuation in fuel pressure etc. with time, thereby deteriorating the emitting condition on the exhaust gas, driveability and the like. More specifically, with respect to tappet clearance, even when the same quantity of air is taken in, if the opening and closing times of an intake valve and an exhaust valve change, then pressure in an intake pipe is fluctuated, and, since the quantity of air is low at the time of light load during idling and the like, compensation cannot be achieved enve by feedback control using an oxygen concentration sensor. Compensation by use of an oxygen condensation sensor can be achieved for the abovedescribed factors including (1) the dispersion in the characteristics curve due to the variability in production, (2) the dispersion in the flow rate characteristics curve of the injector due to the variability in production and (3) the fluctuation in fuel pressure etc. with time due to the variability in production. Unless the correction is made on the influence from the change in offset in (1), the characteristics in the air-fuel ratio control according to the D-J system will not be improved.

SUMMARY OF THE INVENTION

The present invention has been developed to obviate the abovedescribed disadvantages of the prior art and has as its object the provision of a method of learn-controlling the air-fuel ratio for an electronic fuel injection type internal combustion engine, capable of maintaining a stable air-fuel ratio for a long period of time.

To this end, according to the invention, there is provided a method of learn-controlling the air-fuel ratio for an internal combustion engine, comprising the steps of: calculating a basic fuel injection duration TP based on the engine load (the intake-pipe pressure, for example) and the rotational speed of the engine; obtaining a factor of air-fuel ratio feedback correction FAF for allowing a fuel injection duration TAU to perform a proportional-plus-integral action, based on the output of an oxygen sensor for detecting the residual oxygen concentration in an exhaust gas; calculating a mean value FAFAV of the factor of air-fuel ratio feedback correction FAF; varying a correction value by learning so that the mean value FAFAV takes a value within a predetermined range centered at the value of the factor of air-fuel ratio feedback correction corresponding to a target air-fuel ratio (a stoichiometric air-fuel ratio, for example); and obtaining a fuel injection duration based on the basic fuel injection duration TP, the factor of air-fuel ratio feedback correction FAF and the correction value, thereby to control the air-fuel ratio.

According to the invention, the factor of air-fuel ratio feedback correction FAF is obtained from the output of the oxygen sensor. Further, the mean value FAFAV of the factor of air-fuel ratio feedback correction FAF is obtained. The correction value is corrected by learning so that the mean value FAFAV takes a value within a predetermined range centered at the value of the factor of air-fuel ratio feedback correction corresponding to a target air-fuel ratio. Then, a fuel injection duration TAU is calculated based on the basic fuel injection duration TP, the factor of air-fuel ratio feedback correction FAF and the correction value, and the air-fuel ratio is controlled by this fuel injection duration TAU.

In other words, in the case where the air-fuel ratio is controlled so as to be leaner or richer than a target air-fuel ratio due to the influence of the tappet clearance or the like, the mean value FAFAV no longer takes any value within a predetermined range. Therefore, the correction value is corrected by learning to vary the fuel injection duration, thereby to effect control so that the mean value FAFAV takes a value within the predetermined range. More specifically, in the case where the air-fuel ratio is controlled so as to be leaner than a target air-fuel ratio, the mean value FAFAV exceeds the upper limit of a predetermined range. Therefore, the correction value is increased to increase the fuel injection quantity (as a result, the air-fuel ratio is controlled so as to approach the target air-fuel ratio), thereby to effect control so that the mean value FAFAV takes a value within the predetermined range. On the other hand, in the case where the air-fuel ratio is controlled so as to be richer than the target air-fuel ratio, the mean value FAFAV is less than the lower limit of the predetermined range. Therefore, the correction value is decreased to reduce the fuel injection quantity (as a result, the air-fuel ratio is controlled so as to approach the target air-fuel ratio), thereby to effect control so that the mean value FAFAV takes a value within the predetermined range.

Thus, the instability of the air-fuel ratio due to the influence of the tappet clearance or the like is prevented, so that the air-fuel ratio is controlled to converge in proximity of the target air-fuel ratio.

The fuel injection duration TAU in accordance with the present invention can be calculated through the following equation.

$$TAU=(TP+TAUG)\cdot KG\cdot FAF\cdot F(x)+\tau_v \quad (1)$$

Where TAUG is an idling correction value which is corrected by learning during idling and applied to the equation (1) over all the operating zone; KG is an off-idling correction value which is corrected by learning during operation of the engine other than idling and applied to the equation (1); F(x) is a factor of increasing fuel in quantity in accordance with the water temperature, the intake-air temperature, etc; and $\tau_v$ is a non-effective injection duration.

It is to be noted that the off-idling correction value includes a plurality of values (KG1 to KG5, for example) determined in accordance with the intake-pipe pressure, which are corrected by learning in each of regions of the intake-pipe pressure as well as applicable to the equation (1) in each region.

BRIEF DESCRIPTION OF THE DRAWINGS

The abovementioned features and object of the present invention will become more apparent with reference to the following description taken in conjunction with the accompanying drawings wherein like reference numerals denote like elements and in which.

DETAILED DESCRIPTION OF THE INVENTION

Figure 1:
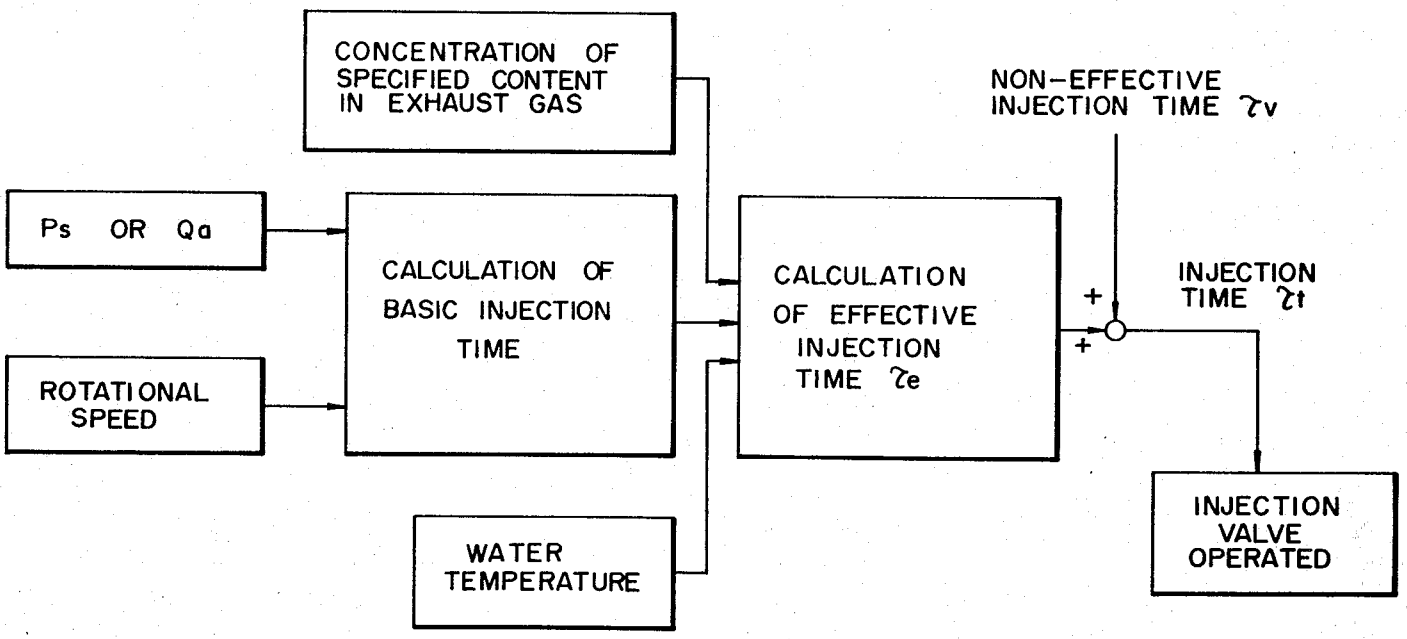
FIG. 1 PRIOR ART
FIG. 1 is an explanatory view of calculation showing the processing of the prior art.
Figure 2:
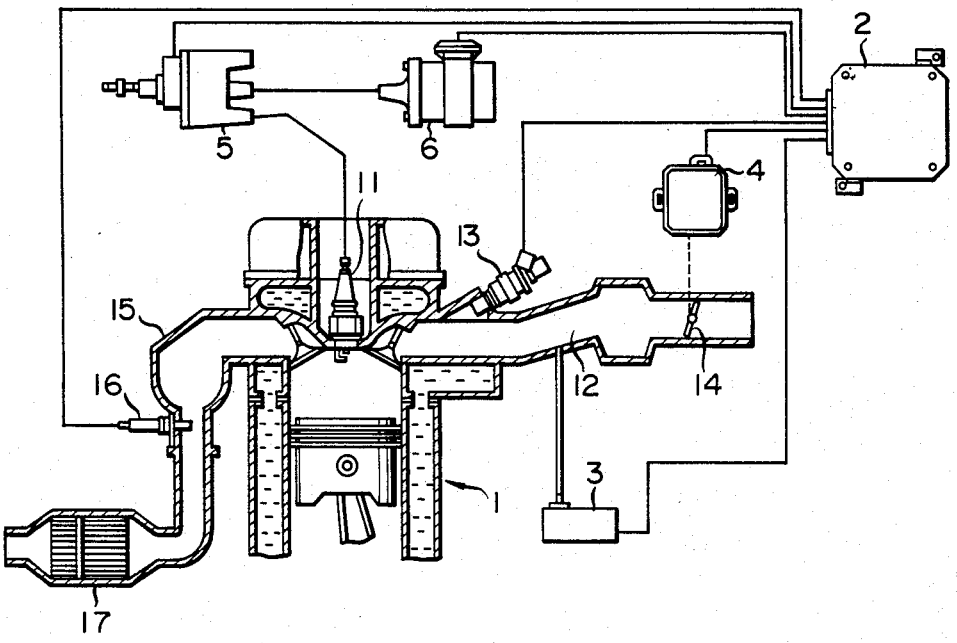
FIG. 2 is a schematic block diagram showing the internal combustion engine suitable for application of the present invention.

FIG. 2 is a schematic block diagram showing the internal combustion engine suitable for application of the present invention. Referring to FIG. 2, secured to the head of an engine 1 is an ignition plug 11 whose ignition surface is exposed in a combustion chamber. An intake pipe is secured to the combustion chamber, and a fuel injection valve 13 is secured to a portion of the intake pipe 12, whereby a supply of fuel is injected into the combustion chamber at each predetermined time. Further, a throttle valve 14 is provided at the forward end portion of the intake valve 12, so that the flow rate of intake air can be regulated. An exhaust pipe 15 is secured to a position opposite to the intake pipe 12 in the combustion chamber, and, an oxygen concentration sensor ($O_2$ sensor) 16 is provided at the intermediate portion of the exhaust pipe 15 and emits two value signals (high and low level voltages) in accordance with the concentration of $O_2$ content contained in the exhaust gas. Further, a three-way catalytic converter 17 is provided in the exhaust pipe 15 for purifying noxious contents HC, CO and $NO_x$ contained in the exhaust gas at the same time.

An electronic control unit (ECU) 2 is adapted to calculate the injection duration and ignition timings based on an output signal from a pressure sensor 3 for detecting an absolute pressure in the intake pipe 12 at the outlet side of the throttle valve 14, an output signal from the $O_2$ sensor 16, an output signal from a throttle full close switch 4 for detecting the fully closed condition of the throttle valve 14, an output signal from a distributor 5 (angular pulses generated at each partial turn of a crankshaft through a predetermined angle) and the like and effect control. In addition, a high output voltage from an ignition coil 6 is applied to the ignition plug 11 through a distributor 5.

Figure 3:
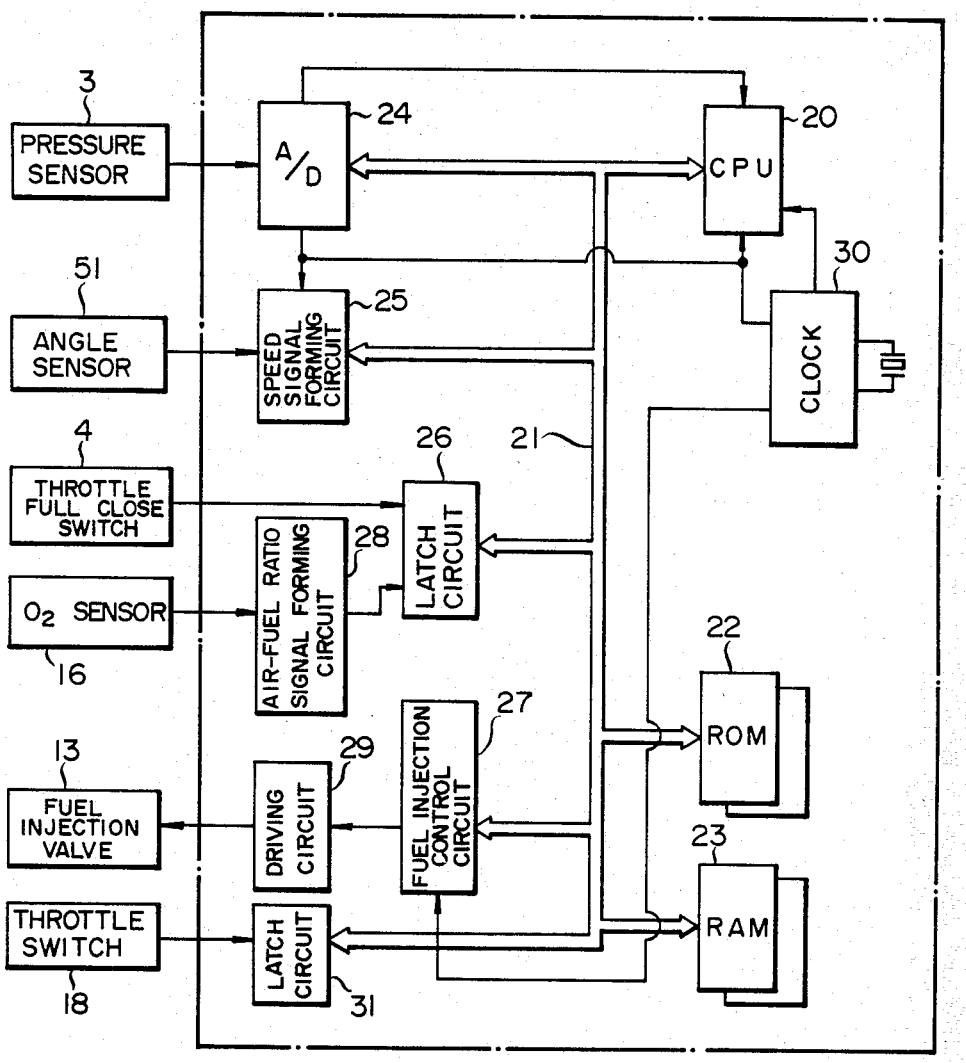
FIG. 3 is a detailed block diagram of the electronic control unit (ECU)2 shown in FIG. 2.

FIG. 3 is a detailed block diagram of the ECU 2 shown in FIG. 2 (Additionally, in the drawing, only the portion of fuel control is shown with other portions omitted). In the ECU 2, there is provided a central processing unit (CPU) 20 as the core thereof, to which are connected through a bus line 21 a ROM 22 and a RAM 23, both of which are memories, an A/D converter 24, a speed signal forming circuit 25, a latch circuit 26, a fuel injection control circuit 27 and a latch circuit 31. In addition, pulse signals having a predetermined interval from a clock generating circuit 30 are applied to the CPU 20, the A/D converter 24, the speed signal forming circuit 25, and the fuel injection control circuit 27 and used as a timing signal or a synchronizing signal. Connected to the A/D converter 24 is the pressure sensor 3 and connected to the speed signal forming circuit 25 is an angle sensor 51. Furthermore, connected to the latch circuit 26 are the throttle full close switch 4 and an air-fuel ratio signal forming circuit 28, respectively, and connected to the air-fuel ratio signal forming circuit 28 is the $O_2$ sensor 16. Further, the fuel injection control circuit 27 is connected to a driving circuit 29 which controls the fuel injection valve 13.

An analogue output voltage from the pressure sensor 3 is converted by the A/D converter 24 into a digital voltage commensurate to the absolute pressure of the intake pipe. An angle pulse signal from the angle sensor 51 is converted by the speed signal forming circuit 25 into digital data commensurate to the rotational speed $N_e$ of the engine. This speed signal forming circuit 25 comprises: a gate controlled in its opening and closing by the angle pulse signal; and a counter for counting the clock pulses from the clock generating circuit 30 for controlling the aforesaid gate. The digital data thus obtained is a signal inversely proportional to the rotational speed $N_e$, which is emitted from the counter. The throttle full close switch 4 generates an output signal only when the throttle valve 14 is at fully closed position, feeds same to the latch circuit 26 where the signal is temporarily stored. An output signal from the $O_2$ sensor is fed to the air-fuel ratio signal forming circuit 28 where the condition of the air-fuel ratio of the engine is converted into a two value signal of "1" or "0" depending on whether the air-fuel ratio of the engine is on either the rich side or the lean side with respect to the stoichiometric air-fuel ratio, and the two value signal is temporarily stored in the latch circuit 26. Likewise, an output from a throttle switch 18, indicating that the throttle open degree is below 7° as "1" level, is temporarily stored in the latch circuit 31. For example, the air-fuel ratio signal forming circuit 28 may comprise: a comparison circuit wherein the analogue output voltage from the $O_2$ sensor is compared with a predetermined reference voltage; and a voltage follower circuit having such a function that the analogue output voltage is converted into a digital signal of "1" or "0" based on the results of the comparison. The respective outputs from the above-described A/D converter 24 and speed signal forming circuit 25 are stored in the RAM 23 through the bus line 21 at predetermined timings.

The fuel injection control circuit 27 comprises a presettable down counter, not shown, and an output register, in which is stored a digital signal corresponding to one injection duration TAU of the fuel injection valve 13 calculated finally by the CPU. When a fuel injection start signal is applied to the fuel injection control circuit 27 at a predetermined timing, the stored values are loaded to the presettable down counter, whereby an output from the fuel injection control circuit 27 is inverted to a high level, thereafter, the value loaded is subtracted therefrom one by one each time a clock pulse is applied from the clock generating circuit to the fuel injection control circuit 27, and the output from the fuel injection control unit 27 is inverted to a low level. This subtraction process generates an injection signal having a holding time equal to the injection duration TAU, and the injection signal operates the fuel injection valve 13 through the driving circuit 29.

The CPU 20 carries out various calculations in accordance with a control program previously stored in the ROM 22 of non-volatile memory. Out of these calculations, the calculation of the fuel injection duration according to the present invention will be described with reference to the drawings.

When an interruption signal generated at each predetermined time or each time a crankshaft of the engine is turned through to a predetermined position is fed to the CPU 20, the CPU 20 calculates the injection duration TAU through the following equation.

$$TAU=(TP+TAUG)\cdot KG\cdot FAF\cdot F(x)+\tau_v \quad (2)$$

Where TP is a basic injection duration determined by the absolute pressure PM in the intake pipe and the rotational speed $N_e$; TAUG is an idling correction value; FAF is a factor of air-fuel ratio feedback correction; F(x) is a factor of increasing fuel in quantity in accordance with the engine cooling water temperature, the intake-air temperature, the accelerating condition, etc.; and $\tau_v$ is a non-effective injection duration. The factor of air-fuel ratio feedback correction FAF is usually about 0.8 to 1.2. TP is calculated such that data on the absolute pressure PM of the intake pipe and the rotational speed $N_e$, both of which have been stored in the RAM 23, are taken into the CPU 20 and calculation is performed through a function $f(PM,N_e)$ using the absolute pressure PM of the intake pipe and the rotational speed $N_e$ as the variables. In general, in calculating through the function $f(PM,N_e)$, $f(PM,N_e)$ is fed to the ROM 22 through addressing, and then, is retrieved from the addresses corresponding to input data PM and $N_e$. The FAF in this case is calculated through the results of detection made by the $O_2$ sensor 16. The injection duration TAU is fed to the fuel injection control circuit 27, whereby the fuel injection valve 13 is controlled for a period of time determined by TAU.

Next, the FAF is calculated in the following specific manner.

Figure 4:
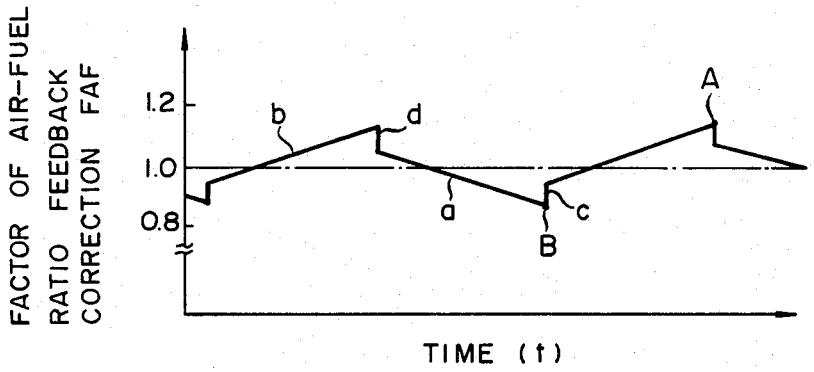
FIG. 4 is a characteristics curve diagram of the factor of the air-fuel ratio correction.

During its main routine or by its interruption routine of a predetermined time, the CPU 20 monitors an output from the air-fuel ratio signal forming circuit 28 and carries out one of two processes depending on the type of the outputs. More specifically, when there is emitted a rich signal indicating that the state of the air-fuel ratio of the engine is richer than a stoichiometric air-fuel ratio, FAF of a section a in the characteristic curve diagram of FAF shown in FIG. 4 is progressively decreased against the time t, and, when there is emitted a lean signal indicating that the state of the air-fuel ratio of the engine is leaner than the stoichiometric air-fuel ratio, FAF of a section b in the characteristic curve diagram of FAF shown in FIG. 4 is progressively increased against the time t. Further, when an output from the air-fuel ratio signal forming circuit 28 is inverted from the rich signal to the lean signal, FAF is increased by a given value indicated by c shown in FIG. 4 (a skip process), and conversely, when the output is inverted from the lean signal to the rich signal, FAF is decreased by a given value indicated by d shown in FIG. 4 (a skip process). Consequently, FAF fluctuates against the time t during control of the air-fuel ratio as shown in FIG. 4. FAF is a proportional-plus-integral signal for controlling the fuel injection duration. Additionally, while the control of air-fuel ratio is interrupted, FAF is fixed in the manner of FAF=1, with no fluctuation occurring.

A correction of the FAF from the center value (1.0) by TAUG and KG controlled by learning is determined and corrected by the CPU 20 in accordance with the operating conditions of the engine.

(a) During idling (the switch 4 is on and the $N_e$ is less than 900 rpm) the following process is followed (where $\alpha$ is an constant value 8$\mu$s, for example, FAFAV is a mean value of FAF).

FAFAV>1.02 . . . TAUG is progressively increased (TAUG←TAUG+$\alpha$).

FAFAV<0.98 . . . TAUG is progressively decreased (TAUG←TAUG−$\alpha$).

0.98≦FAFAV≦1.02 . . . TAUG is maintained at it is.

(b) During operation of the engine other than idling and while the throttle opening is less than a given value (seven degrees, for example), the following process is followed (where K is 0.002, for example).

FAFAV>1.02 . . . KG is progressively increased (KG←KG+K).

FAFAV<0.98 . . . KG is progressively decreased (KG←KG−K).

0.98≦FAFAV≦1.02 . . . KG is maintained as it is.

Corrections of TAUG and KG are made over all the operating zone including the idling condition and the other operating conditions other than the idling, thereby enabling to maintain a stabilized air-fuel ratio.

Figure 5:
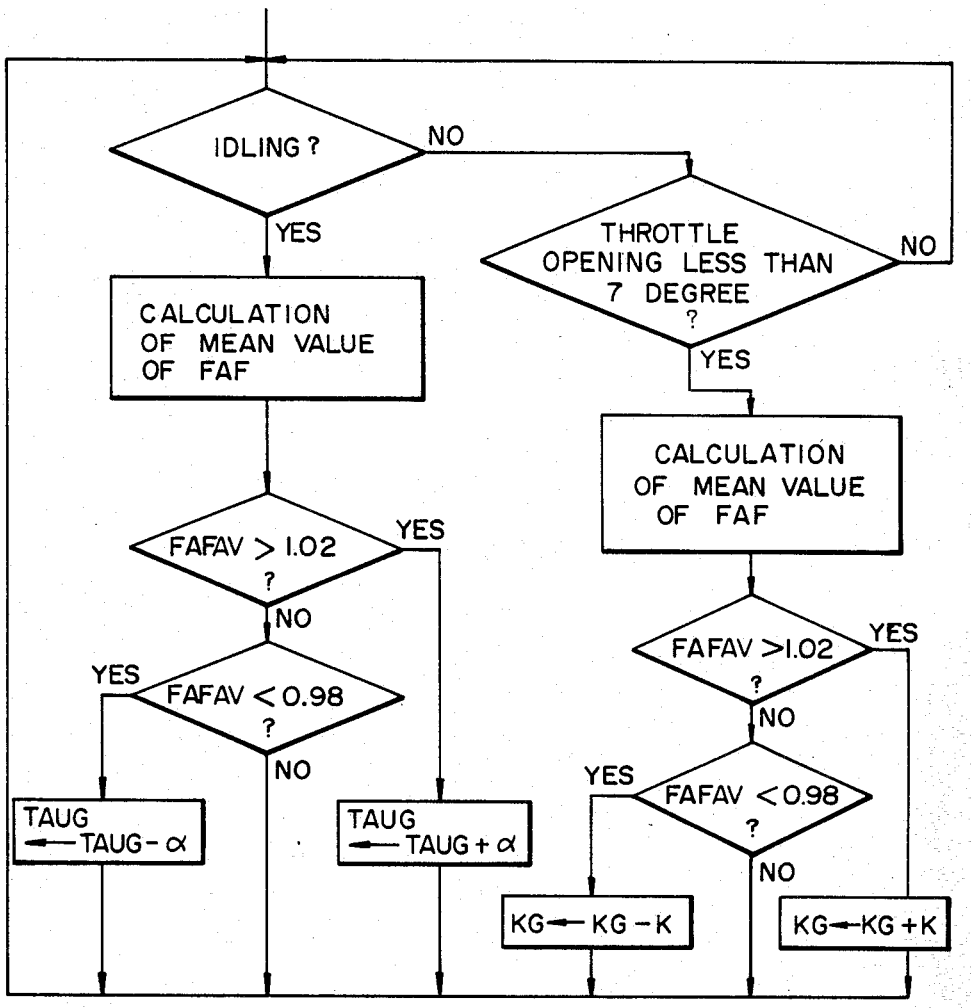
FIG. 5 is a first flow chart showing the processes according the present invention.

FIG. 5 shows the flow chart of the abovedescribed processes followed by the CPU 20.

Firstly, determination of whether idling condition is present or not is made through retrieving by the CPU 20 the output from the throttle full close switch 4 and the output of the speed signal forming circuit 25, and correction calculation processes in two routes are followed based on the result of the determination. If the presence of the idling condition is determined, FAFAV (=(A+B)/2), a mean value of the FAF's prior and posterior to the air-fuel ratio skip. When this FAFAV exceeds the upper limit 1.02 of a predetermined range, the constant value $\alpha$ is added to the value of TAUG at the time to obtain a new TAUG value. When FAFAV<1.02 and FAFAV>0.98, the TAUG value at the time is used for the control of air-fuel ratio. Further, FAFAV<0.98, the constant value $\alpha$ is subtracted from TAUG at the time to obtain a new TAUG value.

Next, when the idling condition is not present and the throttle opening is less than seven degrees, FAFAV, the mean value of FAF is calculated, and if this FAFAV satisfies the conditions of (FAFAV<1.02) and (FAFAV>0.98), the KG at the time is used for the control of air-fuel ratio. When FAFAV satisfies the condition of (FAFAV>1.02), the constant value K is added to the KG at the time to obtain a new KG value. When FAFAV satisfies the condition of (FAFAV<0.98), the constant value K is subtracted from KG at the time to obtain a new KG value. The abovedescribed series of processes are calculated each time an interruption signal by the skip is generated in the CPU 20. TAUG and KG thus corrected are used to correct the TAU in the abovedescribed equation (2), and more specifically, TAUG or KG is increased in value when the air-fuel ratio is on the rich side, and TAUG or KG is increased in value when the air-fuel ratio is on the lean side, thereby enabling FAFAV to converge in proximity of 1.0. In addition, FAFAV, the mean value of FAF is a mean value between the maximum value A and the minimum value B of the factor of air-fuel ratio feedback correction FAF as shown in FIG. 4, and calculated through the following equation.

$$FAFAV = \frac{A+B}{2} \quad (3)$$

As apparent from the foregoing, according to the present invention, in a D-J system fuel injection control engine, the affection due to changes in the tappet clearance can be corrected, so that a stabilized air-fuel ratio can be maintained for a long period of time, the exhaust gas more purified and the driveability at a high level.

Figures 6, 6A:
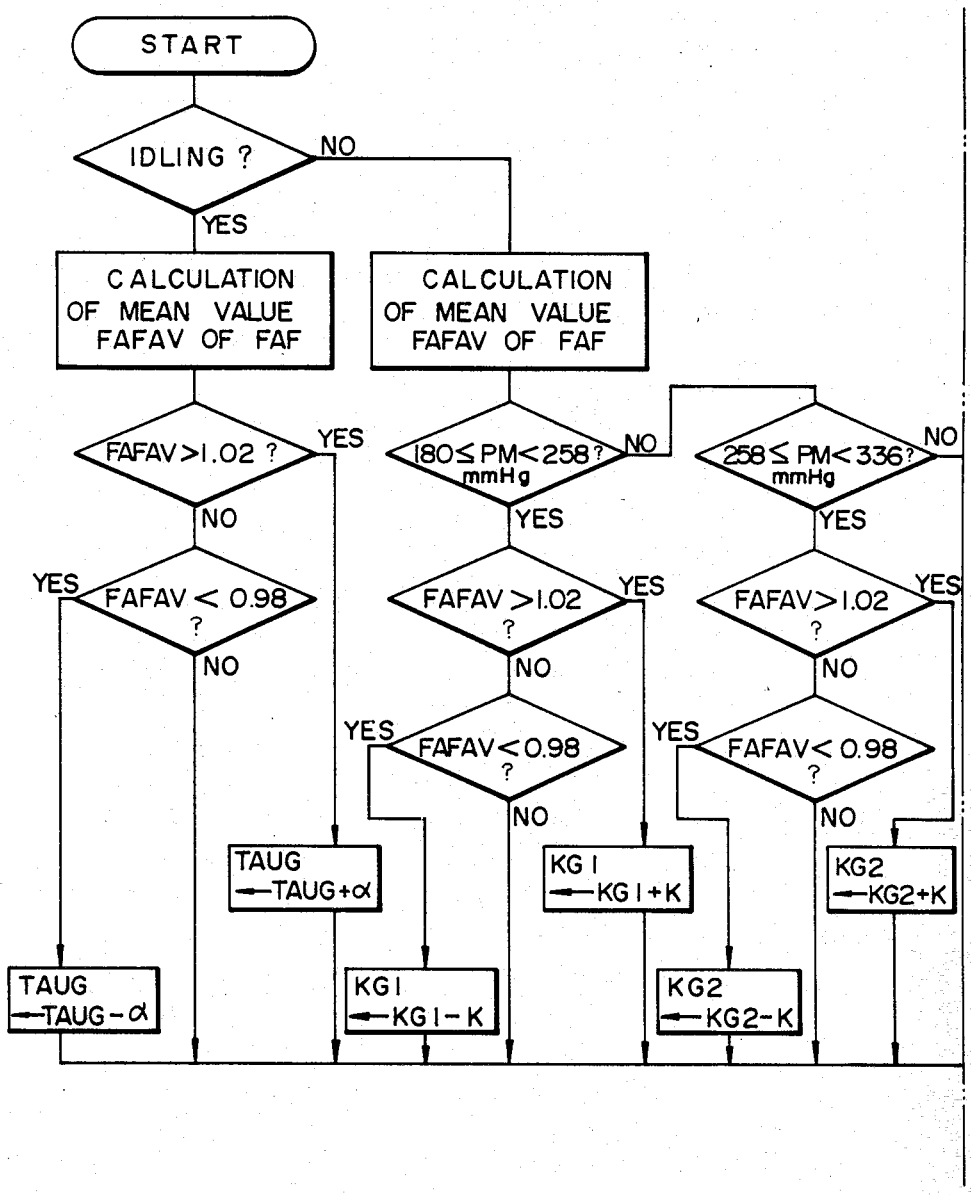
FIGS. 6, 6A, and 6B are a second flow chart showing the processes according to the present invention.
Figure 6B:
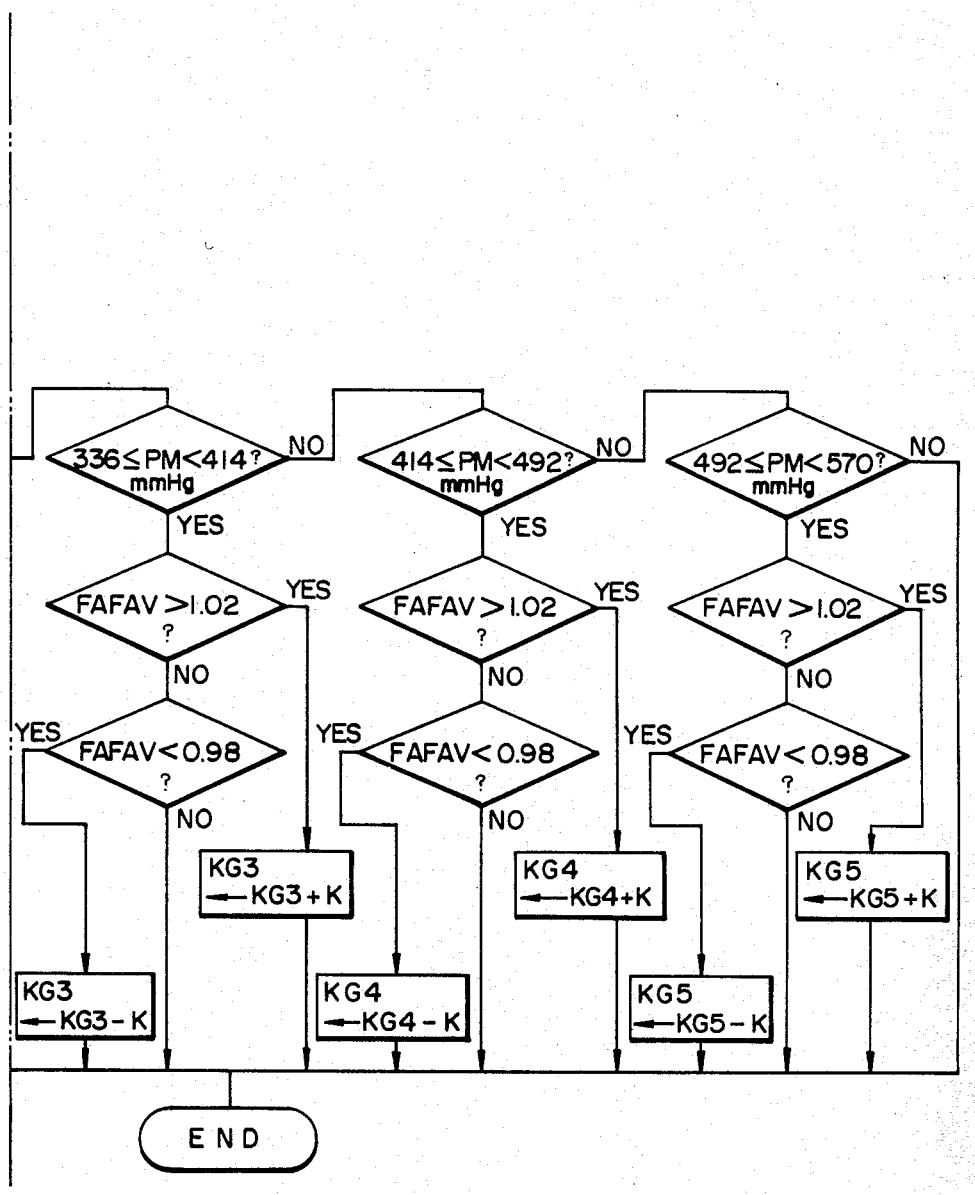

FIG. 6 shows another processing routine for correcting TAUG and KG by learning. In this case, KG is determined in accordance with the intake-pipe pressure as follows.

TABLE 1

| Regions of intake-pipe pressure PM | KG |
|---|---|
| 180 mmHG ≦ PM < 258 mmHg | KG1 |
| 258 mmHG ≦ PM < 336 mmHg | KG2 |
| 336 mmHG ≦ PM < 414 mmHg | KG3 |
| 414 mmHG ≦ PM < 492 mmHg | KG4 |
| 492 mmHG ≦ PM < 570 mmHg | KG5 |

The above-mentioned KG1 to KG5 are corrected by learning for each of the regions of the intake-pipe pressure PM as shown in FIG. 6 and are applied to the abovedescribed equation (2) in the region where correction is made. However, KG1 is applied to the equation (2) even when PM is smaller than 180 mmHg, and KG5 is applied to the equation (2) even when PM is larger than 570 mmHg.

Referring now to FIG. 6, similarly to the processing routine shown in FIG. 5, firstly, determination of whether the idling condition is present or not is made based on the output of the throttle full close switch 4 and the output of the speed signal forming circuit 25. If the presence of the idling condition is determined, the idling correction value TAUG is corrected in the same manner as that shown in FIG. 4. On the other hand, during operation of the engine other than idling, FAFAV, which is a mean value of FAF, is calculated. Thereafter, to which region in Table 1 the present intake-pipe absolute pressure belongs is determined, and then, the correction value in the region to which the present intake-pipe absolute pressure belongs, i.e., KG1, KG2, KG3, KG4 or KG5, is corrected.

What is claimed is:

1. A method of learn-controlling an air-fuel ratio for an internal combustion engine, comprising the steps of:

(a) calculating a basic fuel injection duration TP based on an intake-pipe pressure and a rotational speed of the engine;

(b) obtaining a factor of air-fuel ratio feedback correction FAF for allowing a fuel injection duration TAU to perform a proportional-plus-integral action, based on an output of an oxygen sensor for detecting a residual oxygen concentration in an exhaust gas;

(c) calculating a mean value FAFAV of said factor of air-fuel ratio feedback correction FAF;

(d) increasing an idling correction value TAUG during idling and when said mean value FAFAV exceeds an upper-limit value of a predetermined range including the value of said factor of air-fuel ratio feedback correction corresponding to a target air-fuel ratio, and decreasing said idling correction value TAUG during idling and when said mean value FAFAV is less than the lower-limit value of said predetermined range;

(e) increasing an off-idling correction value KG during operation of the engine other than idling and when said mean value FAFAV exceeds the upper-limit value of said predetermined range, and decreasing said off-idling correction value KG during operation of the engine other than idling and when said mean value FAFAV is less than the lower-limit value of said predetermined range; and (f) calculating the fuel injection duration TAU through the following equation, thereby to control the air-fuel ratio:

$$TAU=(TP+TAUG)\cdot KG\cdot FAF\cdot F(x)+\tau_v$$

where F(x) is a factor of increasing fuel in quantity, and $\tau_v$ is a non-effective injection duration.

2. A method of learn-controlling an air-fuel ratio for an internal combustion engine, comprising the steps of:

(a) calculating a basic fuel injection duration based on an engine load and a rotational speed of the engine;

(b) obtaining a factor of air-fuel ratio feedback correction for allowing a fuel injection duration to perform a proportional-plus-integral action, based on an output of an oxygen sensor for detecting an residual oxygen concentration in an exhaust gas;

(c) calculating a mean value of said factor of air-fuel ratio feedback correction;

(d) varying a correction value by learning so that said mean value takes a value within a predetermined range centered at a predetermined value corresponding to a target air-fuel ratio; and (e) obtaining the fuel injection duration based on said basic fuel injection duration, said factor of air-fuel ratio feedback correction and said correction value, thereby, to control the air-fuel ratio.

3. A method of learn-controlling an air-fuel ratio for an internal combustion engine according to claim 1, wherein said correction value includes an idling correction value varied by learning during idling, and an off-idling correction value varied by learning during operation of the engine other than idling and when an throttle valve opening is less than a predetermined value.

4. A method of learn-controlling an air-fuel ratio for an internal combustion engine according to claim 1, wherein said correction value includes an idling correction value varied by learning during idling, and an off-idling correction value varied by learning during operation of the engine other than idling.

5. A method of learn-controlling an air-fuel ratio for an internal combustion engine according to claim 2, wherein said off-idling correction value includes a plurality of values determined in accordance with an intake-pipe pressure.

6. A method of learn-controlling an air-fuel ratio for an internal combustion engine, comprising the steps of:

(a) calculating a basic fuel injection duration TP based on an intake-pipe pressure and a rotational speed of the engine;

(b) obtaining a factor of air-fuel ratio feedback correction FAF for allowing a fuel injection duration TAU to perform a proportional-plus-integral action, based on an output of an oxygen sensor for detecting a residual oxygen concentration in an exhaust gas;

(c) calculating a mean value FAFAV of said factor of air-fuel ratio feedback correction FAF;

(d) varying an idling correction value TAUG by learning, during idling, so that said mean value FAFAV takes a value within a predetermined range centered at a predetermined value corresponding to a target air-fuel ratio;

(e) varying an off-idling correction value KG by learning, during operation of the engine other than idling, so that said mean value FAFAV takes a value within the predetermined range centered at the predetermined value corresponding to the target air-fuel ratio; and (f) calculating the fuel injection duration TAU through the following equation, thereby to control the air-fuel ratio:

$$TAU=(TP+TAUG)\cdot KG\cdot FAF\cdot F(x)+\tau_v$$

where F(x) is a factor of increasing fuel in quantity, and $\tau_v$ is a non-effective injection duration.

7. A method of learn-controlling an air-fuel ratio for an internal combustion engine according to claim 5, wherein said off-idling correction value includes a plurality of values determined in accordance with the intake-pipe pressure, which are varied by learning in accordance with the intake-pipe pressure.

8. A method of learn-controlling an air-fuel ratio for an internal combustion engine according to claim 5, wherein said predetermined value corresponding to the target air-fuel ratio is 1.

9. A method of learn-controlling an air-fuel ratio for an internal combustion engine according to claim 5, wherein said off-idling correction value KG is varied by learning during operation of the engine other than idling and when a throttle valve opening is less than a predetermined value.

* * * * *